US008499415B2

(12) United States Patent
Bai

(10) Patent No.: US 8,499,415 B2
(45) Date of Patent: Aug. 6, 2013

(54) FLOOR SPRING AND ASSEMBLY METHOD THEREOF

(75) Inventor: Baokun Bai, Guangdong Province (CN)

(73) Assignee: Guangdong Kin Long Hardware Products Co., Ltd., Guangdong Province (CN)

( * ) Notice: Subject to any disclaimer, the term of this patent is extended or adjusted under 35 U.S.C. 154(b) by 288 days.

(21) Appl. No.: 13/043,738

(22) Filed: Mar. 9, 2011

(65) Prior Publication Data

US 2011/0219584 A1 Sep. 15, 2011

(51) Int. Cl.
*E05F 3/22* (2006.01)

(52) U.S. Cl.
USPC ..... 16/55; 16/66; 16/378

(58) Field of Classification Search
USPC ..... 16/49, 51, 54, 55, 66, 68, 50, 71, 16/378, 379
See application file for complete search history.

(56) References Cited

U.S. PATENT DOCUMENTS 1,821,570 A * 9/1931 Norton ..... 16/55
2,223,045 A * 11/1940 Pariot ..... 16/68
2,468,410 A * 4/1949 Schacht ..... 16/55
2,550,756 A * 5/1951 Bartoszek ..... 16/280
2,603,818 A * 7/1952 Carlson ..... 16/55
2,916,762 A * 12/1959 Harty ..... 16/55
2,979,758 A * 4/1961 Shead ..... 16/55
3,103,692 A * 9/1963 Ruck, Jr. et al. ..... 16/82
3,449,789 A * 6/1969 Russell et al. ..... 16/55
3,496,594 A * 2/1970 Arthur ..... 16/49
3,562,848 A * 2/1971 Czapar ..... 16/55
3,576,046 A * 4/1971 Czapar ..... 16/55
3,618,159 A * 11/1971 Jentsch ..... 16/55
3,618,160 A * 11/1971 Ellis ..... 16/55
3,668,737 A * 6/1972 Tillmann ..... 16/55
3,696,462 A * 10/1972 Martin ..... 16/49
3,724,023 A * 4/1973 Tillmann ..... 16/53
3,742,553 A * 7/1973 Sittmann ..... 16/55
4,721,227 A * 1/1988 Hughes et al. ..... 220/560.01
4,996,740 A * 3/1991 Hales et al. ..... 16/378
5,623,747 A * 4/1997 Marinoni ..... 16/49
6,823,561 B2 * 11/2004 Park et al. ..... 16/320

* cited by examiner

*Primary Examiner* — Jeffrey O Brien
(74) *Attorney, Agent, or Firm* — Rosenberg, Klein & Lee

(57) ABSTRACT

A floor spring includes a case, a damper assembly received in the case, and mixed powder filling a space inside the case covering the damper assembly. The damper assembly includes a spindle extending outwardly from the case. The mixed powder can prevent water, dust, or insects enter the case, such that the damper assembly is not tend to rust or fail.

8 Claims, 5 Drawing Sheets

FLOOR SPRING AND ASSEMBLY METHOD THEREOF

BACKGROUND OF THE INVENTION

1. Field of the Invention

The present disclosure relates generally to door closer devices, and more particularly, to a floor spring for automatically moving a door from an open position to a closed position and an assembly method thereof.

2. Description of the Related Art

A conventional automatic door closer operates by storing energy in a spring mechanism during opening of a door and releasing the stored energy to close the door. Automatic door closers are provided with means for controlling the movement of the door, usually involving hydraulic resistance within a floor spring. When the door approaches a fully open or the closed position, a fluid medium within the floor spring is caused to flow through restrictive passages which determine the speed of door movement.

A typical floor spring generally includes a damper assembly received in a case. In order to facilitate the assembly, there is a gap spared between damper assembly and the case. However, since the case is usually imbedded in the floor, water or dust may enter and accumulate in the gap after a period of use, thus constituting a safety hazard and a contamination problem of the damper assembly.

Therefore, there is room for improvement within the art.

SUMMARY OF THE INVENTION

One of the principal objects of the present disclosure is to provide a waterproof and dust-proof floor spring.

According to one embodiment of the present disclosure, a floor spring includes a case, a damper assembly received in the case, including a spindle extending outwardly from the case; and mixed powder filling a space inside the case covering the damper assembly.

Preferably, the mixed powder is insoluble and non-flammable powder, which consists of about 90 vol. % of a light calcium carbonate, about 4 vol. % of talc powder, about 2 vol. % of hard calcium carbonate, about 1 vol. % of calcium stearoyl, about 1 vol. % of antiseptic, and about 1 vol. % of antioxidant.

These and other features of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
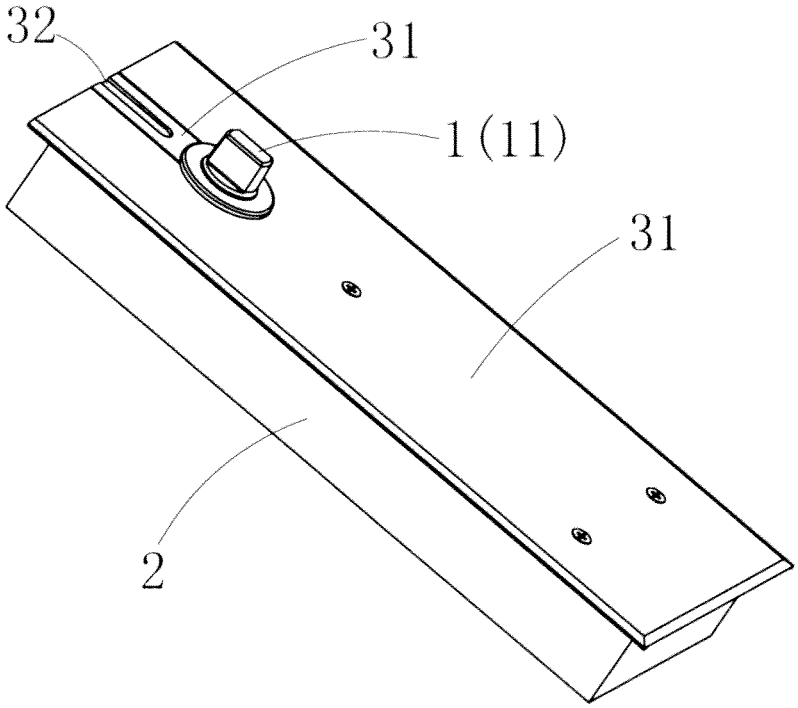
FIG. 1 is a schematic, isometric view of an embodiment of a floor spring.
Figure 2:
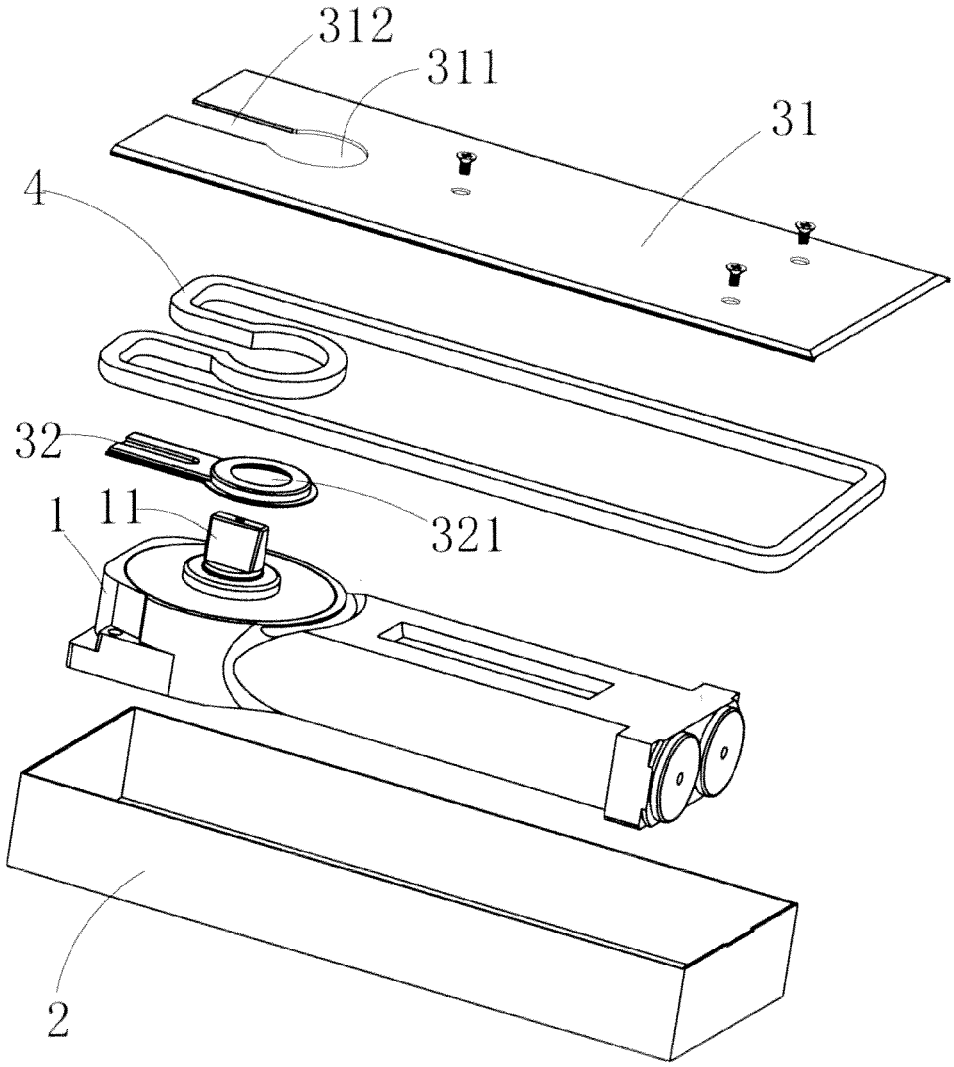
FIG. 2 is an exploded, isometric view of the floor spring of FIG. 1.

Referring to FIG. 1 and FIG. 2, an embodiment of a floor spring 100 is used to open or close a door (not shown). As used herein, the term "open position" for a door means a door position other than a closed position, including any position between the closed position and a fully open position as limited only by structure around the door frame, which can be up to 180° from the closed position. The floor spring 100 includes a case, which is substantially rectangular, and a damper assembly 1 received in the case. The case includes a box 2 and a cover 3. The box 2 is substantially rectangular defining an interior cavity and has an opening 21 into the cavity in a major face. The cover 3 covers the opening 21. The box 2 is located or embedded within a floor or a door frame.

Figure 3:
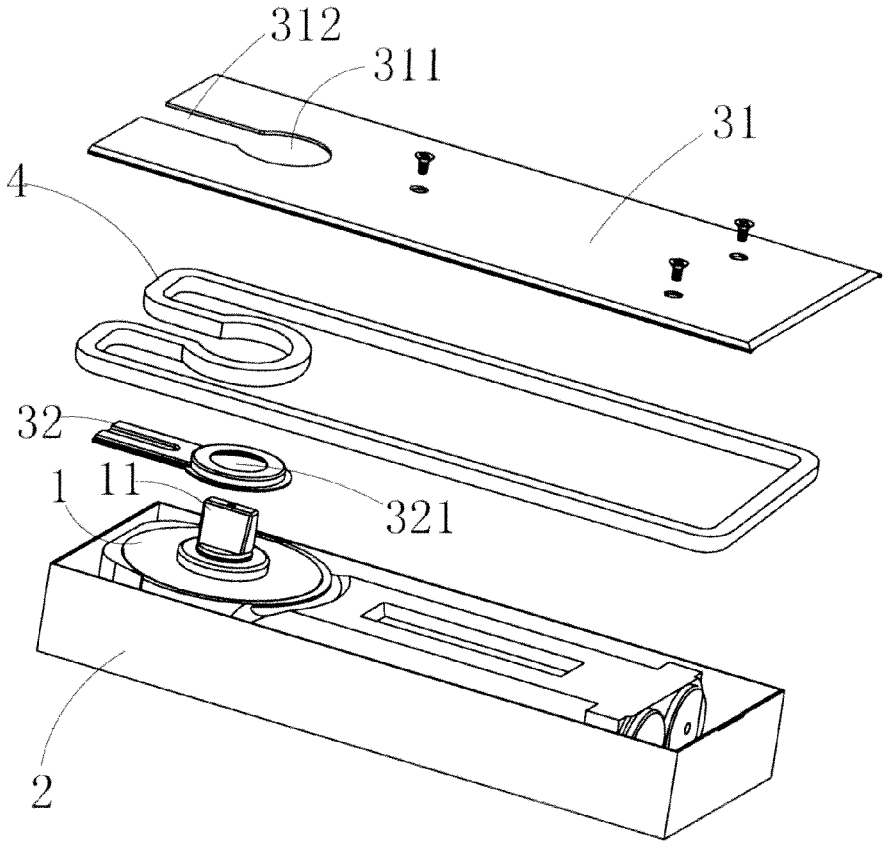
FIG. 3 is similar to FIG. 2, but showing the damper assembly in the box.

Referring also to FIG. 3, the damper assembly 1 is a hydraulic-type damper assembly and includes a rotatable spindle 11 extending outwardly from the case. An upper end of the spindle 11 is non-circular and is secured to the door, such that the spindle 11 rotates relative to the case when the door is opened or closed. Normally, the spindle 11 is in a closed position in which the door supported on it is closed. The damper assembly 1 does not significantly impede movement of the spindle 11 away from this closed position, but once the spindle 11 is so displaced, the damper assembly 1 checks or impedes rotation back to the closed position. The damper assembly 1 is adjustable from the top surface of the case 22 so that the rate at which it allows the spindle 28 to return to its closed position can be varied.

The floor spring 100 further includes mixed powder 5 filling a space inside the case covering the damper assembly 1. The mixed powder 5 is insoluble and non-flammable powder, which consists of about 90 vol. % of a light calcium carbonate, about 4 vol. % of talc powder, about 2 vol. % of hard calcium carbonate, about 1 vol. % of calcium stearoyl, about 1% of antiseptic, and about 1 vol. % of antioxidant.

The cover 3 includes a first cover 31 and a second cover 32. The first cover 31 is substantially rectangular and matches with the opening 21 of the box 2. The first cover 31 defines a first hole 311, which is substantially circular, to receive the spindle 11. The first cover 31 further defines a slot 312 extending from the first hole 311 to a side thereof. The second cover 32 is shaped to match the first hole 311 and the slot 312 and defines a second hole 321 aligned to the first hole 311 to receive the spindle 11.

Figure 4:
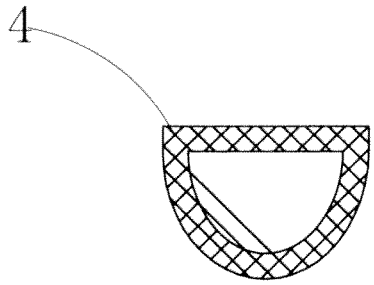
FIG. 4 is an enlarged, cross-sectional view taken along line IV-IV of FIG. 3.

The floor spring 100 further includes a seal member 4 positioned between the first cover 31 and the box 2. Referring to FIG. 4, the seal member 4 fills a gap between the first cover 31 and the second cover 32, the box 2 to increase the tightness of the case. The seal member 4 is a hollow long tube and has a substantially U-shaped cross-section.

Figure 5:
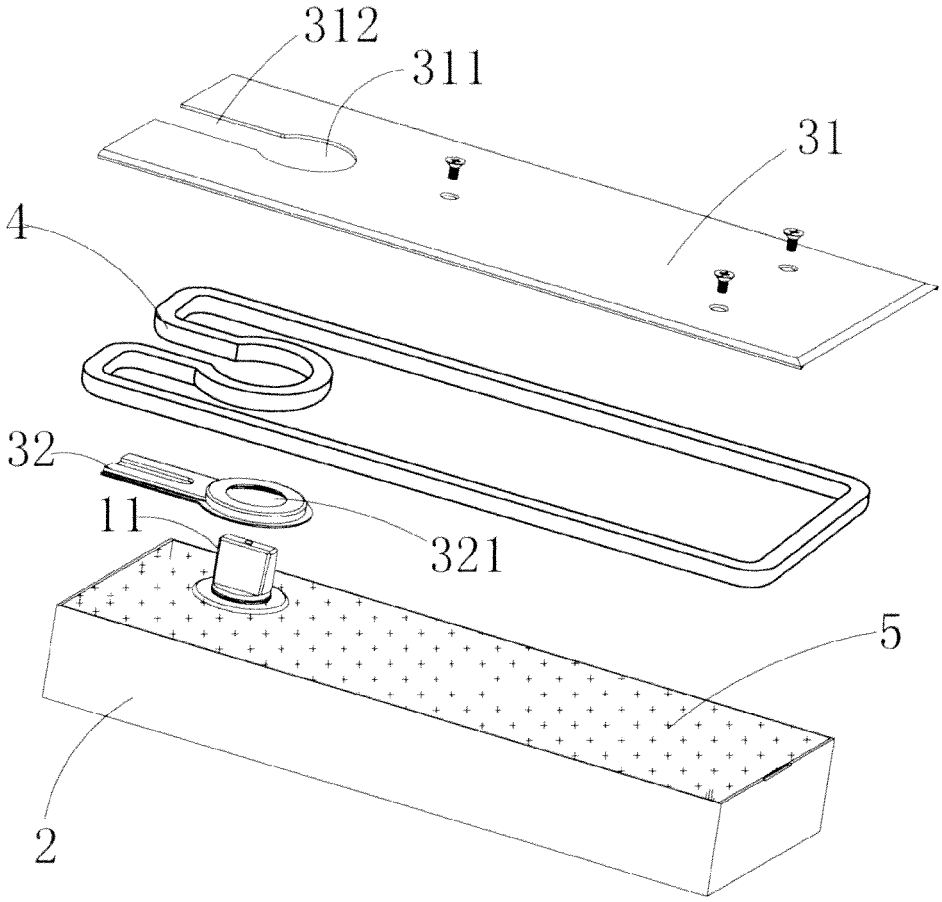
FIG. 5 is similar to FIG. 3, but showing the mixed powder in the box.

Referring to FIG. 5, in assembly, the box 2 is located entirely within the floor or the door frame, then the damper assembly 1 is mounted and fixed in the box 2. The mixed powder 5 is then filled with the box 2 and covers the whole part of the damper assembly 1 except the spindle 11. After that, the second cover 32 is mounted on a top side of the damper assembly and the seal member 4 is positioned on the opening 21. The first cover 31 is finally secured to the box 2 and the second cover 32 by some screws.

The mixed powder 5 can prevent water, dust, or insects enter the box 2, such that the damper assembly 1 is not tend to rust or fail. Furthermore, the mixed powder 5 can keep warm of the damper assembly 1, thus the hydraulic oil in the damper assembly 1 is not likely to be frozen when the floor spring 100 is used in a low temperature environment.

Although the invention has been described in language specific to structural features and/or methodological acts, it is to be understood that the invention defined in the appended claims is not necessarily limited to the specific features or acts described. Rather, the specific features and acts are disclosed as sample forms of implementing the claimed invention.

What is claimed is:

1. A floor spring, comprising:

a case;

a damper assembly received in the case, comprising a spindle extending outwardly from the case; and mixed powder filling a space inside the case covering the damper assembly, wherein the mixed powder is insoluble and non-flammable powder.

2. The floor spring according to claim 1, wherein the mixed powder consists of about 90 vol. % of a light calcium carbonate, about 4 vol. % of talc powder, about 2 vol. % of hard calcium carbonate, about 1 vol. % of calcium stearoyl, about 1 vol. % of antiseptic, and about 1 vol. % of antioxidant.

3. The floor spring according to claim 1, wherein the case comprises a box having an opening, a cover covering the opening; the damper assembly and the mixed powder are received in the box.

4. The floor spring according to claim 3, wherein the cover comprises a first cover and a second cover, the first cover defines a first hole to receive the spindle and a slot extending from the hole to a side of the first cover, the second cover is shaped to match the first hole and the slot and defines a second hole aligned to the first hole to receive the spindle.

5. The floor spring according to claim 4, wherein the second cover is mounted on the damper assembly, the first cover is mounted on the second cover and the damper assembly, the spindle extends through the second hole and the first hole.

6. The floor spring according to claim 5, further comprising a seal member positioned between the first cover and the box.

7. The floor spring according to claim 6, wherein the seal member has a substantially U-shaped cross-section.

8. The floor spring according to claim 7, wherein the seal member is hollow.

* * * * *